United States Patent [19]

Hanson et al.

[11] 4,206,680

[45] Jun. 10, 1980

[54] KEYING IMPROVEMENT FOR CLARINETS

[76] Inventors: Shelley J. Hanson, 3762 N. Cedar St., Apt. 127, Fresno, Calif. 93726; Charles L. Bay, 1285 Brookview Ave., Westlake Village, Calif. 91361

[21] Appl. No.: 940,776

[22] Filed: Sep. 8, 1978

[51] Int. Cl.[2] ..... G10D 7/06

[52] U.S. Cl. ..... 84/382

[58] Field of Search ..... 84/382

[56] References Cited

U.S. PATENT DOCUMENTS

| | | | |
|---|---|---|---|
| 1,926,489 | 9/1933 | Leblanc | 84/382 |
| 2,867,146 | 1/1959 | Mazzeo | 84/382 |
| 3,079,828 | 3/1963 | Leblanc | 84/382 |
| 3,238,833 | 3/1966 | Brodzky | 84/382 |

*Primary Examiner*—L. T. Hix

*Assistant Examiner*—Thomas H. Tarcza

*Attorney, Agent, or Firm*—Fulwider, Patton, Rieber, Lee & Utecht

[57] ABSTRACT

A front-operated Bb key for clarinets, enabling a pure Bb note to be obtained without the player's having to remove his right-hand first finger from its basic finger-hole position. The original side Bb key is extended laterally across the front of the instrument, and downwardly to a position adjacent to the finger-hole normally covered by the first finger of the right hand. An additional spatula is provided for actuation by the first finger in a rolling motion, the spatula contacting the finger at a point near the first knuckle joint. The additional spatula is adjustable in both position and angular orientation, to suit the size and fingering style requirements of different players.

7 Claims, 5 Drawing Figures

KEYING IMPROVEMENT FOR CLARINETS

BACKGROUND OF THE INVENTION

This invention relates to woodwind instruments of the clarinet family, and, more particularly, to an improved technique for fingering the B flat (Bb) note on clarinets.

As is well known, the modern clarinet is a woodwind instrument having a basically cylindrical bore although some sections are conical, and is played by a single-reed mouthpiece. Notes in a fundamental scale of the instrument are produced by uncovering various vent holes normally covered by the fingers or by spring-biased pads. The fundamental scale is extended by "overblowing" the instrument, whereby the frequency of vibration of the air column in the instrument is approximately tripped, and the notes obtained are a twelfth, or about an octave and a half, above the corresponding notes in the fundamental scale. Overblowing is facilitated by opening a small register hole near the top of the instrument, using a register key operated by the thumb of the left hand.

In order to obtain the third-line Bb on the clarinet, i.e., the Bb written as the third line from the bottom of the musical staff in the treble clef, a player must vent either one of two holes in the instrument while simultaneously operating a key known as the throat A key. One of these two holes is the register hole, but when it is used in combination with throat A key, it provides only an approximation of the Bb note. Since the thumb-operated register key for uncovering the register hole can be easily depressed without moving any of the other fingers, it provides a convenient way of obtaining the Bb note, even in difficult passages which require all of the fingers to be on or near their corresponding finger-holes. Unfortunately, however, this technique for obtaining the Bb note is not entirely satisfactory. Because the register hole is reduced in size and is not in the proper position for a Bb, but rather is intended to serve primarily as a means for effecting register changes in the instrument, the Bb obtained is unsatisfactory in both pitch and timbre, or tone quality.

For a more pure and satisfactory Bb note, a clarinet also includes a Bb hole, which is vented by depressing a key known as a trill key or side Bb key on the side of the instrument. The problem with this technique is that the side Bb key must be operated by the first finger of the right hand, and the key can not be reached without removing the finger, at least temporarily, from its position over the finger-hole. Consequently, the side Bb key is easy to operate only in passages which do not require the presence of the fingers of the right hand over their corresponding finger-holes, either immediately before or immediately after the Bb note. When the music does call for the presence of the right hand on the instrument immediately before or immediately after the Bb, it is impossible to vent the side Bb hole without some degree of discontinuity or imperfection in the performance of the musical passage.

While there have been other fingering systems designed to obtain a pure Bb, such as the Mazzeo system, these other systems disadvantageously involve alterations of basic clarinet fingering patterns.

Accordingly, there has long been a need for an improved clarinet which provides for a Bb that is pure in pitch and tone quality, and that may be obtained without removing the right-hand first finger from its position above or on the finger hole. The present invention fulfills this need.

SUMMARY OF THE INVENTION

The present invention resides in an improvement for a clarinet wherein the key utilized to vent the side Bb hole is extended across the front of the instrument, to terminate at a position immediately adjacent the right-hand first finger-hole. Accordingly, the player can, without removing the first finger of the right hand from its position above the finger-hole, actuate the side Bb key with a portion of the finger close to the first knuckle joint, moving the key laterally from right to left and thereby venting the side Bb hole.

More specifically, the improvement of the invention comprises a lever extension rod rigidly affixed by one end to the original spatula of the side Bb key, and extending therefrom across the front of the instrument, and further comprises an additional spatula, and means for adjustably connecting the lever extension rod to the additional spatula in such a manner that the position and orientation of the spatula can be easily adjusted. In the presently preferred embodiment of the invention, the means for adjustably connecting the extension rod to the spatula includes a connecting block having a first hole for receiving an end of the lever extension rod, and a second hole for receiving a pin rigidly attached to or formed integrally with the spatula. The pin and the rod are secured in the block by set screws or similar means, permitting the convenient adjustment of the position and angle of the spatula with respect to the instrument, to suit the player's fingering style and finger size. With this arrangement, the player can easily obtain the Bb note with a pivotal motion that does not alter the position of the first finger of the right hand from its finger-hole. Moreover, this technique provides a certain degree of symmetry, since the A throat key is operated by the first finger of the left hand in a similar rolling type of motion, without altering the basic position of the finger with respect to its finger-hole.

It will be appreciated from the foregoing that the present invention represents a significant advance in clarinet keying arrangements, in that it provides a hitherto unavailable technique for obtaining a pure Bb note without removing the first finger of the right hand from its position above the finger-hole. Other aspects and advantages of the present invention will become apparent from the following more detailed description, taken in conjunction with the accompanying drawings.

DESCRIPTION OF THE PREFERRED EMBODIMENT

Figures 1, 2, 3, 4, 5:
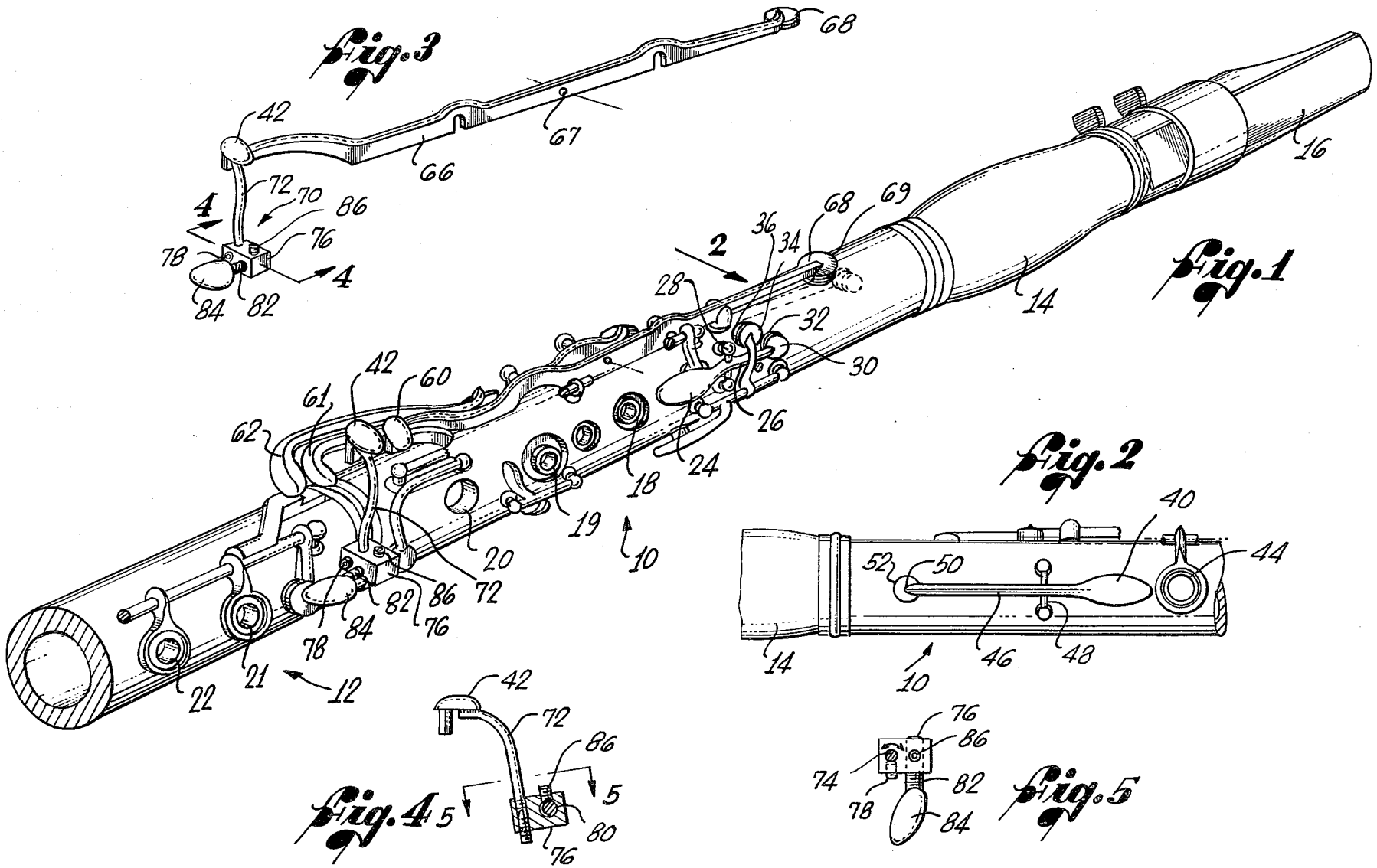
FIG. 1 is a fragmentary perspective view of a clarinet embodying the present invention.
FIG. 2 is a fragmentary elevational view taken in the direction of the arrow 2 in FIG. 1, and showing the register key.
FIG. 3 is a perspective view of the improved Bb key of the invention removed from the clarinet.
FIG. 4 is an enlarged sectional view of the improved Bb key, taken substantially along the line 4—4 in FIG. 3.
FIG. 5 is another sectional view of the key, taken substantially along the line 5—5 in FIG. 4.

As is shown in the drawings for purposes of illustration, the present invention is concerned with a keying improvement for clarinets. The invention has application to all members of the clarinet family, including the soprano clarinet, the sopranino Ab clarinet, the Eb, D, C, Bb, and A clarinets, as well as the alto clarinets, the basset horn, the bass clarinet, and the contra-alto and contrabass clarinets. The invention is also applicable to other types of clarinets pitched in other keys. It is equally applicable to instruments using the Boehm fingering system the Oehler fingering system and nearly all other fingering systems heretofore introduced.

As shown in FIG. 1, a clarinet includes an upper joint, indicated generally by reference numeral 10, and a lower joint 11, only part of which is illustrated. The upper joint 10 and lower joint 11 are generally cylindrical in shape, are of approximately the same length, and fit together to form a continuous somewhat cylindrical column. A shorter section, known as the barrel, indicated at 14, fits to the top end of the top joint 10 and is adapted to receive a mouthpiece 16 on its upper end.

The upper joint 10 has three finger-holes spaced along the front of the joint, indicated at 18–20 in FIG. 1. The first three fingers of the left hand are normally positioned over these holes 18–20, with the fingers either covering or uncovering their respective holes, depending on the notes to be played. For purposes of description, the "front" of the instrument is the segment along which the finger-holes are spaced. The "rear" of the instrument is diametrically opposite the front, and the "right" and "left" sides are as viewed by the player. Finally, the "top" of the instrument in this description means the end at which the mouthpiece 16 is located.

The lower joint 11 also has three finger-holes, of which only the first two are shown, at 21 and 22, and over which the first three fingers of the right hand are normally positioned when playing the instrument. There are also various other holes in the upper and lower joints 10 and 12, and these may be covered or uncovered by movable pads or cups operated by keys through lever mechanisms of various kinds. Most of these holes and keys have been omitted from the drawings for purposes of clarity, but a few are closely related to the invention and will be described more fully.

In order to obtain a Bb note on the clarinet, two keys must be actuated simultaneously. One of these is known as the throat A key, indicated at 24, and is located upwardly from and immediately adjacent to the finger-hole 18 corresponding to the first finger of the left hand. It will be seen that the throat A key 24 is part of a a short lever 26, which is pivotally mounted on a bridge 28, and has, at its end opposite the key 30, a pad that normally covers a hole 32 known as the throat A hole. It will also be seen in FIG. 1 that, when the throat A key 24 is actuated, the lever 26 also functions to lift a second pad 34 covering a hole 36, known as the G# hole, adjacent to and slightly lower than and to the right of the throat A hole 32.

The second key which must be actuated in order to obtain a Bb, in addition to the throat A key, may be either of two keys: a register key 40, shown in FIG. 2, or a side Bb key 42 (FIG. 1). The register key 40 is located at the rear of the instrument immediately adjacent to the normal position for the thumb of the left hand. The thumb of the left hand normally covers a thumb-hole 44 at the rear of the instrument, and the register key 40 is located immediately above the thumb-hole. The register key 40 is a spatula that is rigidly attached to a lever 46 extending upwardly along the rear of the instrument, over a pivot bridge 48, and having at its upper end a pad 50 that normally covers a hole 52, known as the register hole. The key 40 is spring-biased so that the pad 50 covers the register hole 52 unless the key is depressed.

The register hole 52 is the upper-most hole in the instrument and is used primarily to effect register changes in the fundamental notes obtained from the instrument. When the register hole 52 is opened or vented, the third partial of the fundamental note fingered is obtained, i.e. the fundamental frequency is approximately tripled, and a note one twelfth higher on the musical scale is obtained. However, the register key 40 is also used in combination with the throat A key 24 to obtain a Bb. Unfortunately, because the register hole 52 is positioned and sized primarily for the purpose of effecting register changes, the Bb note it provides is unsatisfactory both in pitch and in tone quality.

The second available technique for obtaining a bB, is to use the throat A key 24 in conjunction with the side Bb key 42. The side Bb key is one of four adjacent keys known as trill keys, the others being indicated by reference numerals 60–62. The side Bb key takes the form of a convex spatula, and is normally operated by the first finger of the right hand, contacting the spatula at a point near the second knuckle joint of the finger. The key or spatula is located at the lower end of a relatively long lever 66 that is pivoted close to its geometric center, as indicated at 67, and has a pad 68 at its upper end to cover a hole 69, the Bb hole. The side Bb key 42 provides a Bb that is perfect in both pitch and tone quality, but the key has the disadvantage that it is difficult to operate without removing the first finger of the right hand from its position above the finger-hole. Consequently, in playing a passage requiring right-hand fingering immediately before or after a Bb, the player is forced to obtain the Bb by means of the register key 40, at some sacrifice in purity of pitch and tone quality.

In accordance with the invention, the side Bb key is provided with an extension, indicated generally at 70, terminating in proximity to the finger-hole 21 for the first finger of the right hand, so that the key can be actuated without moving the finger from its position above the finger-hole.

More specifically, the extension 70 of the side Bb key 42 comprises an extension rod 72 secured rigidly to the spatula portion of the side Bb key and extending slightly downwardly of the spatula portion and laterally across the front of the instrument, in the vicinity of the junction between the upper and lower joints 10 and 12. The end of the extension rod 72 remote from the original spatula of the Bb key 42 extends in a hole 74 in an adjustable block 76, and is secured therein by means of a set screw 78.

The extension rod 72 enters the right-hand face of the block, and extends through the hole 74 toward the left-hand face. The set screw 78 is located in an intersecting hole extending from the lower face of the block 76.

Another hole 80 in the block 76 extends from the lower face to the upper face, and is dimensioned to receive a pin 82, to which is attached an additional spatula 84. The spatula 84 presents a convex face in a direction toward the front of the instrument, and extends downwardly toward the right-hand first finger-hole 21. It will be appreciated that the side Bb key may then be actuated either by conventionally depressing the original spatula 42 with an upper portion of the first finger of the right hand, or by using a lower portion of the same finger in a rolling motion against the additional spatual 84, so that the spatula is contacted by the finger at a position close to or further out than the first knuckle joint. The pin 82 to which the additional spatula 84 is attached is secured in the block 76 by a second set screw 86. The pin 82 and the end of the extension rod 72 are preferably both grooved to obtain a more positive locking action by the set screws 78 and 86.

It will be appreciated that the block 76, and with it the spatula 84, may be adjustably moved, both laterally, along the end of the extension rod 72, and rotationally about the rod. In addition, the spatula 84 may be moved up and down with respect to the block 76, and rotated in the block. These four adjustments of the position and angular orientation of the spatula 84 allow it to be adjusted to suit the finger size and fingering style of the player.

The improved side Bb key of the invention can be fabricated to include only the additional elements, i.e., the rod 72, block 76 and spatula 84. However, this can present a practical manufacturing problem, since most of the rigidly connected metal parts of the instrument are fabricated by soldering. The original spatula of the side Bb key 42 is soldered to the lever 66, and it is not an easy task to solder the rod 72 to the spatula without simultaneously detaching it from the lever 66. A preferred technique of installing the improvement is to cut the originally provided lever 66 at a specified point along its length, below the pivot point 67, then to solder on a replacement portion for the removed section of the lever, the replacement portion having already attached to it all the elements of the key extension 70.

It will now be appreciated that, with the invention installed, the player may actuate the side Bb key by either the old technique, requiring rather extreme repositioning of the first finger of the right hand from above its finger-hole, or by utilizing the invention to actuate the key without removing the finger from its ideal finger-hole position. The rolling motion of the finger, used to actuate the new Bb key by the spatula 84, is almost identical to the motion of the first finger of the left hand, in actuating the throat A key 24. Consequently, the improvement of the invention is easily learned, and is one with which most players feel comfortable after very little practice. The invention can also be used to facilitate operation of the Bb key in performing trills, such as the second-line G# to A trill, and the second-line G to A trill.

It will also be appreciated from the foregoing that the present invention provides a significant improvement over conventional clarinet keying techniques for obtaining the Bb note. In particular, the invention allows a player to obtain a Bb which is pure in pitch and tone quality, while at the same time permitting the player to perform passages requiring the presence of the first finger of the right hand above or on its finger-hole before or after the Bb note. Although a particular embodiment of the invention has been described in detail for purposes of illustration, various modifications may be made without departing from the spirit and scope of the invention. Accordingly, the invention is not to be limited except as by the appended claims.

We claim:

1. For use on a clarinet, having fingerholes that are selectively uncovered to produce corresponding musical notes, and also having a side Bb hole and a corresponding conventional side Bb key normally operated by the first finger of the right hand, after removal of the finger from its basic finger-hole position, the improvement comprising:

means for extending the length of said side Bb key to a position adjacent to the finger-hole for the first finger of the right hand, whereby said key may be actuated by said first finger without relocating the finger from its basic finger-hole position.

2. For use on a clarinet, having fingerholes that are selectively uncovered to produce corresponding musical notes, and also having a side Bb hole and a corresponding conventional side Bb key normally operated by the first finger of the right hand, the improvement comprising:

means for extending the length of said side Bb key to a position adjacent to the finger-hole for the first finger of the right hand, whereby said key may be actuated without relocating the finger from its basic finger-hole position, wherein said means for extending the length of said side Bb key includes an extension rod rigidly attached to said conventional Bb key and extending laterally across the clarinet therefrom, a spatula, and connecting means for coupling said rod to said spatula in such a manner that said spatula extends downwardly along the front of said clarinet toward the finger-hole for the first finger of the right hand.

3. The improvement as set forth in claim 2, wherein said connecting means includes means for adjusting the position and angular orientation of said spatula, to suit the needs of a particular player.

4. The improvement as set forth in claim 2, wherein said connecting means includes:

a pin rigidly connected to said spatula;

a block having a first hole therethrough in a lateral direction for receiving an end of said extension rod, and having a second hole therethrough in an axial direction for receiving said pin;

means for securing said rod in said first hole to permit adjustment of said block position angularly and laterally; and means for securing said pin in said second hole to permit adjustment of said spatula position angularly and axially.

5. The improvement as set forth in claim 4, wherein said means for securing said rod and said pin are set screws.

6. A clarinet having finger-holes and having a side Bb hole and a corresponding side Bb key normally operable by the first finger of the right hand, wherein the improvement comprises:

an extension of said side Bb key, including a rod rigidly secured to said side Bb key and extending laterally across the front of the clarinet, a coupling block to which said rod is adjustably secured, to permit lateral and rotational adjustment of said block with respect to said rod, a pin adjustably secured to said block and extending axially toward the first finger-hole for the right hand, and a spatula rigidly secured to said pin, and movable in a lateral direction to actuate said side Bb key without removal of the first finger of the right hand from its finger-hole position.

7. A clarinet as set forth in claim 6, wherein the improvement further comprises two set screws engaged in said block to secure said rod and said pin, respectively, adjustably in said block.

* * * * *